US007105063B1

(12) United States Patent
Gibson et al.

(10) Patent No.: US 7,105,063 B1
(45) Date of Patent: Sep. 12, 2006

(54) METHOD AND MATERIALS FOR EXTENDING FUSER MEMBER LIFE

(75) Inventors: George A. Gibson, Fairport, NY (US); Richard E. Eisemann, Webster, NY (US); Santokh S. Badesha, Pittsford, NY (US); David J. Gervasi, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 11/275,666

(22) Filed: Jan. 23, 2006

(51) Int. Cl.
*B08B 3/04* (2006.01)

(52) U.S. Cl. ..... 134/26; 399/327; 399/328; 399/330; 399/333; 492/46; 492/56; 134/1; 134/6; 134/30; 134/36; 134/40; 134/42

(58) Field of Classification Search ..... 399/327, 399/328, 330, 333; 492/46, 56; 134/6, 26, 134/1, 30, 36, 40, 42
See application file for complete search history.

(56) References Cited

U.S. PATENT DOCUMENTS

| | | | | |
|---|---|---|---|---|
| 3,980,424 | A | 9/1976 | Latone | |
| 4,018,555 | A | 4/1977 | Thettu | |
| 4,040,383 | A | 8/1977 | Vandervort | |
| 4,101,267 | A | 7/1978 | Mueller | |
| 4,257,699 | A | 3/1981 | Lentz | |
| 5,017,432 | A | 5/1991 | Eddy et al. | |
| 5,166,031 | A | 11/1992 | Badesha et al. | |
| 5,281,506 | A | 1/1994 | Badesha et al. | |
| 5,306,349 | A * | 4/1994 | Nee | 134/1 |
| 5,337,133 | A | 8/1994 | Siegel et al. | |
| 5,366,772 | A | 11/1994 | Badesha et al. | |
| 5,370,931 | A | 12/1994 | Fratangelo et al. | |
| 5,649,130 | A | 7/1997 | Nakajima et al. | |
| 5,689,789 | A | 11/1997 | Moser | |
| 5,835,838 | A * | 11/1998 | Yu | 399/350 |
| 5,939,486 | A * | 8/1999 | Yu | 524/722 |
| 6,298,216 | B1 | 10/2001 | McMindes et al. | |
| 2005/0241732 | A1* | 11/2005 | Ishigami et al. | 148/245 |

* cited by examiner

*Primary Examiner*—Sharidan Carrillo
(74) *Attorney, Agent, or Firm*—Oliff & Berridge, PLC

(57) ABSTRACT

A method of treating a fuser member surface to extend the life thereof includes applying to the fuser member surface an ethylene diamine tetraacetate. In addition, the fuser member may be subjected to a sonic treatment during the application of the ethylene diamine traacetrate in order to remove additional materials therefrom that are resistant to removal by the ethylene diamine traacetate.

23 Claims, No Drawings

METHOD AND MATERIALS FOR EXTENDING FUSER MEMBER LIFE

BACKGROUND

Described herein are methods for extending the life of a fuser member, and materials for use in such methods. More in particular, described are methods and materials for removing potentially damaging materials from a fuser member surface.

Fuser members may be utilized in many different applications for fusing and/or fixing a toner image to an image receiving medium. For example, a fuser member may be used in electrophotographic and/or xerographic devices (e.g., copying machines), facsimile devices, printers, and the like.

In a typical electrophotographic or xerographic process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into proximity therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to an image receiving substrate such as copy paper. The toner particles are heated at a fusing station to permanently affix the image to the copy sheet.

In order to fuse the image formed by the toner onto the paper, electrophotographic devices include a fuser. While the fuser may take many forms, heat or combination heat-pressure fusers are currently most common. One combination heat-pressure fuser includes a heat fusing roll in physical contact with a hard pressure roll. These rolls cooperate to form a fusing nip through which the copy sheet (the sheet on which the document is finally formed) passes.

Fuser rolls are typically in the form of a rotating cylinder, with an outer surface comprising a thin elastomeric layer that contacts the copy material. The outer surface may include a release agent, such as silicone oil, to prevent toner from adhering to the surface of the fuser roll itself. Fuser rolls commonly used have outer layers of a thickness on the order of 0.002–0.07 inches (2 to 70 mils), while typical pressures exerted on the outer layer of a fuser roll are on the order of 50 to 150 psi.

The life of a fuser member is limited by several failure mechanisms. The surface or bulk properties of the elastic material used for coating of the roll can, for instance, become degraded by prolonged exposure to high temperature. Another mechanism is the wear of the roll caused by paper abrasion. Still other mechanisms include the attachment of high molecular weight materials such as oligomers or other decomposition products of the silicone oil release agent commonly employed in fuser systems. The formation rate of these products may be increased by the presence of impurities (for example, toner components, paper components or environmental contaminants). Additionally, some of these contaminants may react in the fuser nip, forming a polar salt layer that covers the surface of the roll. When this occurs, toner from the image is more prone to offset to the fuser member surface and be re-deposited at another part of the print or copy. Such toner offset to the fuser member surface is undesirable and results in degraded image quality. This adhesion of toner to the roll is also believed to be a first step in the cascade leading to stripping failure, wherein the image receiving substrate adheres to the fuser member surface rather than being easily stripped therefrom, and ultimately to fuser member failure.

REFERENCES

Various efforts have been employed in the art in an effort to combat offset.

U.S. Pat. No. 5,649,130 describes a cleaning sheet for a fuser roll, wherein an average diameter of fibers constituting the cleaning sheet is not more than 14 μm. The sheet includes a layer containing not less than 30% by weight of softening fibers that soften at a temperature higher than an ambient temperature of the fuser roll, but lower than a temperature that is 100° C. higher than a surface temperature of the fuser roll. The cleaning sheet is bonded with adhesive fibers having a fiber diameter of not more than 20 μm. The cleaning sheet is wound off a roll and contacted with the fuser roll by a pinch member. See the Abstract.

U.S. Pat. No. 4,101,267 describes a fuser apparatus for utilization in a xerographic reproducing apparatus for fixing toner images adhered to substrates, wherein the fuser apparatus comprises a heated fuser roll and a backup roll cooperating therewith to form a nip through which the substrates pass with the toner images contacting the heated fuser roll. A non-contact silicone oil applicator is provided together with a metering blade for applying a uniformly thick coating on the surface of the fuser roll which coating serves to minimize the effect of toner. See the Abstract.

U.S. Pat. No. 4,040,383 describes an apparatus for uniformly applying toner-release lubricant to, and for cleaning, heated fusing rolls used in copying or reproduction machines. The apparatus comprises a lubricant-dispensing roll containing an internal supply of lubricant, an applicator roll for transferring lubricant from the dispenser roll to the fuser roll and for wiping the fuser roll, and a spreader roll for evenly distributing the lubricant on the applicator roll prior to the completion of transfer to the fuser roll. The dispenser roll is designed to (1) dispense lubricant uniformly and substantially continuously over approximately 270° of each revolution, regardless of the oil level therein, and (2) preclude the dispensing of lubricant when not in use. See the Abstract.

U.S. Pat. No. 4,018,555 describes a contact fuser assembly for use in electrostatic reproducing apparatus, the assembly including a heated fuser roll structure cooperating with a backup roll to form a nip through which copy sheets or substrate material having toner images thereon move with the toner images contacting the heated fuser roll structure. The fuser assembly is characterized by the provision of a cleaning arrangement comprising a roll having a tacky surface which is adapted to contact the fuser roll structure to thereby remove toner and other contaminants therefrom with subsequent embedding of the contaminants in the tacky surface. See the Abstract.

U.S. Pat. No. 3,980,424 describes an improved cleaning roller for cleaning residual toner particles from a heated fuser roll of a heated pressure fusing system in an electrostatic copy machine. The cleaning roller is mounted on a carriage supporting one or more cleaning rollers in contact with the surface of the heated fuser roll. A pressure loading mechanism applies a force on the carriage and cleaning rollers against the surface of the heated fuser roll. Each cleaning roller has a core member that is covered with a sleeve of soft suitable material such that under the pressure loading condition the surface of the cleaning roller conforms to that of the heated fuser roll. The exterior surface of each cleaning roller has a toner coating mixed with silicone oil to insure proper release of the residual toner from the heated fuser roll onto the cleaning roller. See the Abstract.

Besides fuser member cleaning devices, additional efforts have been made to extend fuser member life.

U.S. Pat. No. 5,337,133 describes a system to extend fuser roll life in which image data is varied in its placement on the photoreceptive member and correspondingly, the image receiving substrate position is varied so as to maintain proper location of the image data on the substrate while varying the transverse position of the substrate transverse to the paper path direction. This position varying may take place sheet to sheet or in a job by job arrangement on a printing machine. This varying of lateral position of the sheet causes the high pressure, excessive wear area on the fuser roll to be distributed over a wider area on the roll and not concentrated at a single point at each edge of the sheet. This leads to longer fuser roll life and additionally provides the added benefit of preventing an oil buildup that degrades copies when larger legal size sheets are utilized and/or also preventing associated jams due to the oil buildup at the sheet edge. See the Abstract.

SUMMARY

While many of the aforementioned cleaning methods are effective in removing stray toner from the surface of the fuser member, the methods often do little to extend the fuser member life as a result of a build-up of other contaminants on the fuser member surface. What is still desired are methods and materials for extending the fuser member life through removal of such additional damaging contaminants.

In embodiments, described is a method of cleaning a fuser member surface, comprising applying to the fuser member surface an ethylene diamine tetraacetate.

In further embodiments, described is a method of cleaning a fuser member surface, comprising contacting the fuser member surface with an ethylene diamine tetraacetate solution and subjecting the fuser member surface to a sonic treatment.

In a still further embodiment, described is an image forming device comprising a charging component, an imaging component, a photoconductive component, a developing component, a transfer component, and a fusing member component, wherein the fusing member component includes a fuser member surface, and wherein the fuser member surface is cleaned in accordance with the above-identified methods.

The methods and materials herein thus have utility in extending the life of fuser members by removing contaminant materials from the fuser member surface, which contaminant materials are not removed by conventional fuser member surface cleaning methods.

EMBODIMENTS

A fuser member, as described in embodiments herein, can have different configurations and sizes. For example, fuser members can be formed as fuser rolls or as fuser belts, and can also have other different configurations such as films, sheets and the like. The fuser member may typically be in the form of a roll. The fuser members may be used in various devices, for example including in electrophotographic or xerographic devices, in printers, in facsimile devices, and the like.

The fuser member may comprise a substrate having an outer layer, for example an outer elastomeric layer, formed over the substrate. The fuser member may optionally also include one or more adhesive layers, cushion layers, or other suitable layers positioned between the substrate and the outer layer.

In embodiments, a heating element may be disposed in a hollow portion or center core of the substrate. In other embodiments, the heating element may be located external to the fuser member. Optionally, both external and internal heating elements can be used together with a given fuser member.

The substrate of the fuser member may have any of various configurations, for example including roll or cylindrical sleeve, belt, flat surface, sheet, film, or any other suitable shape that may be used in the fixing of a toner image to a suitable image receiving medium. The substrate may comprise any suitable metallic material, such as aluminum, anodized aluminum, steel including stainless steel, nickel, copper and the like. The substrate may also be formed of non-metallic materials, or mixtures of metallic and non-metallic materials. For example, the substrate may be formed of plastic materials having suitable rigidity and structural integrity, as well as being capable of being coated with materials comprising the outer layer of the fuser member.

The outer layer of the fuser member may be an elastomeric material. Exemplary suitable elastomers for forming the outer layer of the fuser member may include fluorocarbon elastomers. Suitable fluorocarbon elastomers are described, for example, in U.S. Pat. Nos. 4,257,699, 5,017,432, 5,166,031, 5,281,506, 5,366,772 and 5,370,931, each of which is incorporated herein by reference in its entirety. Fluoroelastomers, particularly from the class of copolymers, terpolymers and tetrapolymers of vinylidenefluoride, hexafluoropropylene and tetrafluoroethylene, and a possible cure site monomer, are known commercially under various designations of VITON® (E.I. DuPont de Nemours, Inc.). Other commercially available and suitable fluoroelastomers include FLUOREL® (3M Company), AFLAS (a poly(propylene-tetrafluoroethylene) elastomer available from 3M Company), KALREZ® (E.I. DuPont de Nemours), KEL-F (3M Company) and TECNOFLONS® (Ausimont USA, Inc.).

Other elastomers suitable for use herein may include silicone rubbers such as, for example, room temperature vulcanization (RTV) silicone rubbers; high temperature vulcanization (HTV) silicone rubbers and low temperature vulcanization (LTV) silicone rubbers. Such rubbers are available commercially as, for example, SILASTIC® (Dow Corning), SYLGARD (Dow Corning), Dow Corning 806A, 106 RTV Silicone Rubber and 90 RTV Silicone Rubber (General Electric). Other silicone materials may include fluorosilicones such as nonylfluorohexyl and fluorosiloxanes such as DC94003 and Q5-8601 (both available from Dow Corning), siloxanes such as polydimethylsiloxanes, fluorosilicones, dimethylsilicones, liquid silicone rubbers such as vinyl crosslinked heat curable rubbers or silanol room temperature crosslinked materials, mixtures thereof and the like.

The outer layer of the fuser member may contain any suitable additives, for example including additives for thermal conductivity and/or abrasion resistance such as, for example, metals or metal alloys such as, for example, iron, nickel and cobalt, graphite, metal oxides such as, for example, aluminum oxide, zinc oxide, iron oxide and molybdenum disulfide, and mixtures thereof.

Two types of contaminant materials that are typically not able to be removed from the elastomeric surface of the fuser member by conventional residual or stray toner cleaning methods are salt layers and gel layers.

Salt layers may form on the surface of a heated fuser member through reaction of conventional toner additives, for example such as zinc stearate, or other sources of metal ions, with acidic materials such as, for example, toner decomposition products or residual monomers used in the toner formation process, for example such as fumaric acid. The salt layer may also form from the products of oxidative decomposition of endogenous or exogenous materials such as, for example, silicone fuser oil, environmental contaminants, organic paper contaminants, and the like. A common salt layer may thus be comprised of, for example, a zinc salt such as, for example, zinc fumarate.

The salt layer presence on the fuser member surface may be confirmed through use of, for example, electron microscopy. The presence of the salt layer may cause performance degradation of the fuser member. The difficulty is that the salt layer is resistant to most common solvents.

In embodiments, the fuser member surface is subjected to a cleaning wherein an ethylene diamine tetraacetate is applied to the surface of the fuser member.

An advantage of the treatment of the fuser member surface with the ethylene diamine tetraacetate is that any salt layer that may have formed on the fuser member surface is substantially removed from the surface of the fuser member by the application. Substantially removed in embodiments herein refers to, for example, removal of the salt layer (or gel layer as will be discussed below) such that following removal, less than about 10% of the total surface area of the fuser member, for example from 0% to about 10% or from 0% to about 5% of the total surface area, contains the salt or gel layer. Where remaining present, the salt or gel layer may have a thickness of less than about 5 μm, for example from about 0.001 μm to about 5 μm or from about 0.1 μm to about 3 μm.

The ethylene diamine tetraacetate is a salt of ethylene diamine tetraacetic acid (EDTA). Examples of salts of EDTA that may be used include sodium or potassium salts, or metal oxalate or acetylacetonate salts, where the metal element is any of, for example, Cr, Cd, Ti, Zn, Zr and the like. The ligand may be a bidentate and/or a polydentate ligand such as a tridentate ligand. The salt may particularly be a tetrasodium ethylene diamine tetraacetate.

The ethylene diamine tetraacetate may be used in a solution, for example by dissolution of the ethylene diamine tetraacetate in a suitable solvent such as deionized water, isopropanol, blends thereof and the like. The solution may contain the ethylene diamine tetraacetate in an amount of from about 0.5% to about 80%, such as from about 1% to about 50% or from about 1% to about 30% by weight of the solution. In embodiments, the ethylene diamine tetraacetate solution to be applied may have a pH of from, for example, about 7 to about 11, or from about 7 to about 10 or about 7.5 to about 10. To achieve the desired pH, pH adjusting agents, for example such as $NaHCO_3$, sodium or potassium acetate, sodium phosphate, weak solutions of acids and bases such as sodium or potassium hydroxide or acetic acid, and the like, may be added to the solution in appropriate amounts as needed.

The application of the ethylene diamine tetraacetate to the fuser member surface may be conducted in conjunction with a treatment to remove residual release agents such as silicone oil from the surface of the fuser member. During operation of a fusing system in which heat is applied to cause thermal fusing of the toner particles onto a support, both the toner image and the support are passed through a nip formed between the fuser member and another roll, a plate, a belt, and the like. The concurrent transfer of heat and the application of pressure in the nip achieves the fusing of the toner image onto the support. During fusing, it is desired to avoid toner particles offsetting from the image receiving surface to the fuser member surface as toner particles offset onto the fuser member may subsequently transfer to other parts of the machine or onto the support in subsequent copying cycles, thus increasing the background or interfering with the material being copied there. To ensure and maintain good release properties of the fuser member, it has become customary to apply release agents to the fuser member surface during the fusing operation. The release agents are typically comprised of a silicone oil, in particular a polydimethyl silicone oil, which is applied to the fuser member surface to act as a toner release material. The release agent thus acts to prevent toner offset.

A treatment to remove the release agents, in particular silicone oil, may be done either before, at the same time as, or after the application of the ethylene diamine tetraacetate to the fuser member surface. The treatment to remove the residual silicone oil from the fuser member surface may include, for example, applying a suitable solvent such as hexane, methylene chloride, toluene, acetone, mixtures thereof and the like, a surfactant, or a combination thereof to the fuser member surface. The surfactant may be any suitable surfactant, for example including ionic, anionic, non-ionic or cationic surfactants and the like. Example surfactants include, for example, TRITON-X non-ionic surfactant, ALCONOX, cetyl trimethylammonium bromide, sodium laureth sulfate, sodium dodecyl sulfate, ammonium lauryl sulfate, alkyl poly(ethylene oxide), mixtures thereof and the like. Where a solvent is used, it may be used to treat the fuser member surface separate from application of the solution containing the ethylene diamine tetraacetate. Where a surfactant is used, it may be included in the solution containing the ethylene diamine tetraacetate, for example in an amount of from about 1% to about 50%, such as from about 5% to about 25% or from about 5% to about 10% by weight of the solution.

In addition to the ethylene diamine tetraacetate, the treating solution may also contain additional chelating agents capable of complexing with specific metal ions and/or salts thereof that may be expected to be formed on the fuser member surface, for example specific metal ions expected to be present as a result of the composition of the toner and/or additives of the toner. Examples of additional chelating agents include citric acid, oxalic acid, phytic acid, hydroxyethylethylenediaminetriacetic acid, nitrilotriacetic acid; 1,3-diketones such as, for example, acetylacetone and thenoyltrifluoroacetone; monothiophosphinic acid, phosphorothioic acid, mixtures thereof and the like.

Other optional materials that may be included in the ethylene diamine tetraacetate solution include, for example, co-solvents, additional buffers, multiple surfactants or multiple chelating agents, and the like.

The application of the ethylene diamine tetraacetate to the fuser member surface may be conducted in any suitable manner. The application may be done while the fuser member is still mounted within the device it is used in, or it may be done by removing the fuser member from the device for external cleaning.

In embodiments, the application may be done while the fuser member remains in the device, for example by having the fuser member moved or rotated to a cleaning station within the device or by applying the ethylene diamine tetraacetate to the fuser member when the device is not actively fusing toner images, for example when the device is in a sleep mode or other period of inactivity.

In embodiments, the application may be accomplished by, for example, having the fuser member pass through a bath containing the ethylene diamine tetraacetate, with or without use of a fuser member surface contacting device such as a brush or other physical device for assisting in the removal of contaminants such as the salt layer from the surface of the fuser member. The fuser member should be permitted to remain in or pass through the bath for a sufficient amount to permit substantial removal of any salt layer(s) on the fuser member surface. A cycle lasting, for example, from about 1 minute to about 2 hours, such as from about 10 minutes to about 1 hour or from about 10 minutes to about 30 minutes, may be suitable.

In other embodiments, the application may be accomplished by including the ethylene diamine tetraacetate in a wipe material, and contacting the fuser member surface with the wipe material. For example, the ethylene diamine tetraacetate may be loaded into any suitable material that can be wiped across or over the fuser member surface. Such materials may include, for example, a pad, cloth or blanket of natural or synthetic materials, for example a CHEMWIPE towlette and the like, a brush, and the like. The wipe material should be permitted to contact and pass across or over the fuser member surface a sufficient number of times to permit substantial removal of any salt layer(s) on the fuser member surface. For example, the wipe may be passed from about 1 to about 50 times, such as from about 2 to about 25 times or from about 5 to about 15 times, over surface portions of the fuser member.

The ethylene diamine tetraacetate is most suitably applied to the surface of the fuser member when the fuser member is substantially cool, for example when the fuser member surface is about 50° C. or less, for example from about 20° C. to about 50° C. or from about 20° C. to about 35° C.

Following the application of the ethylene diamine tetraacetate to the fuser member surface, the fuser member surface may be washed, for example with deionized water. The washing should remove any residual ethylene diamine tetraacetate from the fuser member surface. Following washing, the fuser member may be dried prior to use for fusing, although the drying may be achieved when the fuser member surface is subjected to the heat of the fusing operation, which will rapidly dry the fuser member surface.

In further embodiments, the fuser member surface is subjected to a cleaning wherein the fuser member surface is contacted with an ethylene diamine tetraacetate solution and subjected to a sonic treatment.

The accumulation of a layer of silicon-containing gel may also appear on the surface of fuser members, for example as a result of the use of a silicone oil release agent in the fusing operation. This gel layer may hide the low energy surface of the fuser member, and may likely cause formation of gel marks on prints or copies, as well as cause offset failure as described previously. This gel layer is typically impervious to removal by wiping or common solvents, and is often commingled with the salt layer described previously.

An advantage of contacting the fuser member surface with a solution of ethylene diamine tetraacetate in conjunction with subjecting the fuser member surface to a sonic treatment is that any such gel layer may be substantially removed from the fuser member surface. A further advantage is that the contact with the solution of ethylene diamine tetraacetate also removes any salt layers from the fuser member surface, as was discussed above.

The ethylene diamine tetraacetate for use in this combined treatment may be any of the ethylene diamine tetraacetate materials discussed above. For example, the salt may particularly be a tetrasodium ethylene diamine tetraacetate. The ethylene diamine tetraacetate may be used in a solution, for example by dissolution of the ethylene diamine tetraacetate in a suitable such as discussed above. In embodiments, the ethylene diamine tetraacetate solution may have a pH of from, for example, about 7 to about 11, or from about 7 to about 10 or about 7.5 to about 10.

As discussed above, the contacting of the ethylene diamine tetraacetate while subjecting the fuser member surface to a sonic treatment may be conducted in conjunction with a treatment to remove residual release agents such as silicone oil from the surface of the fuser member. Thus, here again the ethylene diamine tetraacetate solution may contain a suitable surfactant to assist in removal of the release agent. Also, as discussed above, the solution may further contain additional chelating agents capable of complexing with specific metal ions and/or salts thereof that may be expected to be deposited on the fuser member surface.

The contacting of the ethylene diamine tetraacetate solution to the fuser member surface while applying a sonic treatment to the fuser member surface may be conducted in any suitable manner. Here again, the application may be done while the fuser member is still mounted within the device it is used in, or it may be done by removing the fuser member from the device for external treatment. Thus, in embodiments, the treatment may be done while the fuser member remains in the device, for example by having the fuser member moved or rotated to a cleaning station within the device or by conducting the treatment when the device is not actively fusing toner images.

In embodiments, the application may be accomplished by, for example, having the fuser member immersed in or passed through a bath containing the ethylene diamine tetraacetate solution and with which is associated a device for applying the sonic treatment. As above, the bath may also have associated therewith a fuser member surface contacting device such as a brush or other physical device, for example a wipe, for assisting in the removal of contaminants such as the salt layer from the surface of the fuser member.

The fuser member should be subjected to the sonication treatment in the ethylene diamine tetraacetate bath for a sufficient amount of time to permit substantial removal of any salt layer(s) and/or gel layer(s) on the fuser member surface. A treatment lasting, for example, from about 0.1 minutes to about 30 minutes, such as from about 0.5 minutes to about 15 minutes or from about 0.5 minutes to about 10 minutes, may be suitable. The sonic treatment may be an ultrasonic treatment, for example through use of any commercially available ultrasonic bath. During the treatment, the sonication may be low power sonication. Such low power may protect the fuser member from shear induced interfacial weakening and the derivitization of the fuser member surface that might accompany higher energy and/or temperature treatments. Thus, the power of the sonic treatment may be, for example, a frequency of from about 10 to about 60 kHz, for example from about 20 to about 50 kHz, at from about 50 to about 500 Watts, for example from about 100 to about 400 Watts. Again, any commercially available low power ultrasonic bath may be used for the treatment.

As with the treatment of the fuser member without sonication as discussed above, the treatment with ethylene diamine tetraacetate in conjunction with a sonic treatment may suitably be conducted when the fuser member is substantially cool, for example when the fuser member surface is about 50° C. or less, for example from about 20° C. to about 50° C. or from about 20° C. to about 35° C.

Following the treatment, the fuser member surface may be washed, for example with deionized water, as discussed above, and also optionally dried.

The fuser member to be treated in accordance with embodiments herein may be included in an image forming device comprising a charging component, an imaging component, a photoconductive component, a developing component, a transfer component, and a fusing member component, wherein the fusing member component includes a fuser member surface, and wherein the fuser member surface is treated in accordance with the methods described herein at a treatment station within the image forming device.

As the image forming device, such may be referred to as an electrostatographic, electrophotographic and/or xerographic device. The device employs a photoconductive component, for example a belt or drum. The photoconductive member moves to advance successive portions sequentially through the various processing stations disposed about the path of movement thereof.

Initially, a portion of the photoconductive surface passes through a charging station. At the charging station, the a portion of the photoconductive member is charged, for example by one or more corona generating devices, to a relatively high, substantially uniform potential.

Next, the charged portion of the photoconductive surface is advanced through an imaging station. At the imaging station, an original document is positioned on a scanning device such as a raster input scanner (RIS), a device known in the art. The RIS captures the entire image from original document and with an imaging module records an electrostatic latent image on the photoconductive surface of the photoconductive member. The imaging module may include, for example, a raster output scanner (ROS). The ROS lays out the electrostatic latent image in a series of horizontal scan lines with each line having a specified number of pixels per inch. Other types of imaging systems may also be used employing, for example, a pivoting or shiftable LED write bar or projection LCD (liquid crystal display) or other electro-optic display as the "write" source.

Thereafter, the photoconductive member advances the electrostatic latent image recorded thereon to a development station. At the development station, toner is applied to the electrostatic latent image to form a toner powder image on the photoconductive member surface. Any suitable development system may be used, for example including magnetic brush developers, hybrid jumping developers, cloud developers, and the like. The toner may be supplied from a developer, for example comprised of the toner and carrier particles. Thus, at the development station, developer material is brought near the electrostatic latent image, and the latent image attracts toner particles from the carrier granules of the developer material to form a toner powder image on the photoconductive surface.

The toned image on the photoconductive member surface is then advanced to a transfer station, where an image receiving substrate such as a paper sheet is moved into contact with the toner powder image. The toner image is transferred to the image receiving substrate via any suitable process. Following transfer, the image receiving substrate is advanced to the fusing station.

The fusing station may include a fuser assembly that permanently affixes the transferred toner powder image to the image receiving substrate. The fuser assembly may include the heated fuser member such as a fuser roll and a pressure roller, with the powder image on the image receiving substrate contacting the fuser roll. The pressure roller is cammed against the fuser roll to provide the necessary pressure to fix the toner powder image to the substrate. The fuser roll may be internally heated, for example by a quartz lamp, and/or externally heated as discussed above. Release agent such as silicone oil, stored in a reservoir, may be pumped to a metering roll that feeds the release agent to the fuser roll. The image sheet is passed between the nip of the pressure roller and fuser roll, where the heat and pressure act to melt and fix the toner image to the image receiving substrate.

The fuser member may then be cooled when treatment at the cleaning station is desired or required. Again, as was discussed above, the cleaning station may be located at or near the fuser member so that the treatments can be effected, particularly the application of the ethylene diamine tetraacetate to the fuser member surface, without removing the fuser member from the device.

Although use of a fuser member in a xerographic device has been detailed, the fuser member may also be employed in other devices, for example including printers, facsimile machines and the like, as discussed above.

The following examples further illustrate the methods described herein.

In a first example, a fuser roll having a 25 μm thick layer of zinc fumarate formed thereon is treated as follows. First, a 100 mM solution of tetrasodium ethylene diamine tetraacetate in deionized (DI) water and having a pH of about ~8 (by hydrion paper) was prepared and used to wet a CHEMWIPE towelette. This moistened towel was used to wipe a segment of the fuser roll 10 times. The roll segment was rinsed with more DI water and allowed to dry. A subsequent microscopic assay using an energy dispersive X-ray spectrometer from EDAX and/or SEM (scanning electron microscopy) that provides qualitative or quantitative elemental analysis and/or mapping of samples showed that substantially all of the zinc containing material had been removed from the fuser member surface.

In a second example, a fuser roll having a 25 μm thick layer of zinc fumarate formed thereon and having commingled therewith a silicon rich gel layer is treated as follows. First, a 100 mM solution of tetrasodium ethylene diamine tetraacetate in deionized (DI) water and having a pH of about ~8 (adjusted to Ph of about 8 with $NaHCO_3$) is added to an ultrasonic bath, specifically a common jeweler's bath. Low power sonication is then applied for 1 minute. A subsequent microscopic assay including EDAX showed that substantially all of the zinc containing material and substantially all of the silicon rich gel material is removed from the fuser member surface.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of cleaning a fuser member surface of an electrophotographic device comprising:

(a) providing a fuser member having a surface, said surface having at least one contaminant generated during use of an electrophotographic device and, (b) applying to the fuser member surface an ethylene diamine tetraacetate so as to contact the fuser member surface with the ethylene diamine tetraacetate to remove the at least one contaminant.

2. The method according to claim 1, wherein the applying comprises including the ethylene diamine tetraacetate in a wipe material, and contacting the fuser member surface with the wipe material.

3. The method according to claim 1, wherein the applying comprises passing the fuser member through a bath or immersing the fuser member in a bath, wherein the bath includes the ethylene diamine tetraacetate therein.

4. The method according to claim 1, wherein the fuser member surface comprises a fluorocarbon elastomer.

5. The method according to claim 1, wherein the at least one contaminant is a salt layer that is substantially removed by the applying.

6. The method according to claim 1, wherein the applying is conducted on the fuser member surface when the fuser member surface is at about 20° C. to about 35° C.

7. The method according to claim 1, wherein the ethylene diamine tetraacetate is in a solution having a pH of about 7 to about 10.

8. The method according to claim 1, wherein the ethylene diamine tetraacetate is a tetrasodium ethylene diamine tetraacetate.

9. The method according to claim 1, wherein the applying further comprises applying a surfactant with the ethylene diamine tetraacetate.

10. The method according to claim 1, wherein the method further comprises treating the fuser member surface to substantially remove a silicon oil release agent therefrom prior to applying the ethylene diamine tetraacetate.

11. The method according to claim 1, wherein following the applying of the ethylene diamine tetraacetate, the fuser member surface is washed with deionized water.

12. The method according to claim 5, wherein the salt layer comprises a reaction product of a metal ion source with an acidic material, an oxidative decomposition product of toner material, or combinations thereof.

13. The method according to claim 5, wherein the salt layer includes a zinc salt.

14. A method of cleaning a fuser member surface of an electrophotographic device comprising the steps of:

(a) providing a fuser member having a surface, said surface having at least one contaminant generated during the use of an electrophotographic device, (b) contacting the fuser member surface with an ethylene diamine tetraacetate solution, and (c) subjecting the fuser member surface to a sonic treatment, wherein said contacting and subjecting steps remove the at least one contaminant.

15. The method according to claim 14, wherein the contacting comprises placing the fuser member surface in a bath containing the ethylene diamine tetraacetate solution.

16. The method according to claim 14, wherein the sonic treatment is conducted for about 0.1 to about 30 minutes.

17. The method according to claim 14, wherein the sonic treatment is conducted at a frequency of from about 10 to about 60 kHz at from about 50 to about 500 Watts.

18. The method according to claim 14, wherein the at least one contaminant is a silicon-containing gel that is substantially removed by the contacting and the sonic treatment.

19. The method according to claim 14, wherein the ethylene diamine tetraacetate solution has a pH of about 7 to about 10.

20. The method according to claim 14, wherein the ethylene diamine tetraacetate is a tetrasodium ethylene diamine tetraacetate.

21. The method according to claim 15, wherein the sonic treatment is an ultrasonic treatment.

22. The method according to claim 15, wherein the sonic treatment is conducted while the fuser member surface is in the bath.

23. The method according to claim 18, wherein the at least one contaminant further comprises a salt layer that is substantially removed by the contacting and the sonic treatment.

* * * * *